United States Patent [19]

Odom et al.

[11] Patent Number: 5,025,144

[45] Date of Patent: Jun. 18, 1991

[54] RESISTIVE ANODE ENCODER TARGET AND METHOD PRODUCING BATHS CHARGED AND VISUAL IMAGES

[76] Inventors: Robert W. Odom, 446 Jackson Ave., Redwood City, Calif. 94062; Michael D. Strathman, 5616 S.E. Hawthorne Blvd., Portland, Oreg. 97215

[21] Appl. No.: 254,442

[22] Filed: Oct. 6, 1988

[51] Int. Cl.[5] ..... H01J 40/14

[52] U.S. Cl. ..... 250/207; 250/213 VT

[58] Field of Search ..... 250/207, 213 VT, 369, 250/372; 313/103 CM, 105 CM

[56] References Cited

U.S. PATENT DOCUMENTS

| | | | |
|---|---|---|---|
| 3,676,676 | 7/1972 | Somer | 250/207 |
| 3,691,382 | 9/1972 | Somer | 250/207 |
| 3,715,594 | 2/1973 | Drohan et al. | 250/372 |
| 3,965,354 | 6/1976 | Fletcher et al. | 250/372 |
| 4,024,390 | 5/1977 | Bosserman et al. | 250/207 |
| 4,217,489 | 8/1980 | Rosier | 313/103 CM |
| 4,345,153 | 8/1982 | Yin | 250/369 |

*Primary Examiner*—David C. Nelms
*Assistant Examiner*—Stephone B. Allen

[57] ABSTRACT

The present invention is directed to method and means for converting an energetic radiation image into an accelerated electron image, impacting the accelerated electron image onto an anode target to create both a charge image an a visible light image, producing signals representative of at least one of the two spatial coordinates of the electrons on the target and transmitting the visible light image for viewing.

23 Claims, 3 Drawing Sheets

RESISTIVE ANODE ENCODER TARGET AND METHOD PRODUCING BATHS CHARGED AND VISUAL IMAGES

BACKGROUND OF THE INVENTION

This invention relates to an image converter method and apparatus for imaging of energetic radiation which term is used herein to include soft x-ray, gamma-ray and ultraviolet electromagnetic radiation, ions, electrons, photons and high energy particles.

It is known that two dimensional position and intensity distributions of incident energetic radiation can be determined by converting the incident radiation into an amplified burst of electrons and determining the position at which this burst of electrons strikes an anode or target element. Position determination can be performed by ratioing the charge collected at selected locations, such as four corners, on the anode or target, or by measuring the arrival time of the partitioned charges at these locations. The anode or target can either be a uniform resistive film or a regularly spaced geometric pattern of conducting wedges and strips.

A resistive anode image converter or encoder employing an optically opaque, carbonaceous anode film is described in U.S. Pat. No. 3,965,354 to M. L. Lampton and F. Paresce issued in the name of NASA and in an article Rev. Sci. Instrum. 45 (9), 1098 (1974). A low distortion anode fabricated using unspecified thick film resistor techniques was described by M. Lampton and C. W. Carlson in Rev. Sci. Instrum. 50 (9), 1093 (1979). A commercial resistive anode encoder product utilizing a thick film resistor anode and charge ratio detection circuitry was introduced in 1979 by Surface Science Laboratories, in Mountain View, California. The wedge and strip anodes are described in the articles by C. Martin, P. Jelinsky, M. Lampton and R. F. Malina Rev. Sci. Instrum 52 (7), 1067 (1981) and O. H. W. Siegmund, R. F. Malina, K. Coburn, and D. Werthimer, IEEE Transactions On Nuclear Science, Vol. NS-31, 1, 776 (1984).

The resistive anode image converter described in U.S. Pat. No. 3,965,354 to NASA includes two cascaded microchannel electron multiplier plates which both detect and amplify soft x-rays and ultraviolet electromagnetic radiation and charged particles which impinge upon the front surface of the first microchannel electron multiplier plate. A contiguously mounted continuous resistive anode which functions as a target for the amplified electron image produced by the microchannel multiplier plates is provided with a pulse position analysis circuit for producing electrical signals which represent the spatial coordinates of the points of impact of the electrons, which comprise the electron image, upon the resistive anode. U.S. Pat. No. 4,345,153 in the name of L. I. Yin and also issued to NASA discloses a spectrometer for imaging, counting and energy resolving employing alternative embodiments which use either a visible light output or a position sensing anode such as a resistive anode, cross grid anode or quadrant anode but not both. The resistive anode encoder and the visible light output devices suffer from the lack of both a quantitative resistive anode and a visual or qualitative indication of the position and intensity of the radiation incident on the microchannel plate assembly.

SUMMARY OF THE INVENTION

The object of the present invention is to provide a resistive anode encoder which produces both a quantitative measure as well as a qualitative or visual indication of the position and intensity of the radiation incident on the microchannel plate.

Broadly stated that present invention is directed to method and means for converting an energetic radiation image into an accelerated electron image, impacting the accelerated electron image onto an anode target to create both a charge image and a visible light image, producing signals representative of at least one of the two spatial coordinates of the electrons on the target and transmitting the visible light image for viewing.

In accordance with an aspect of the present invention the anode is at least partially transparent and includes a layer of fluorescent material on the anode surface facing the means for converting the energetic radiation image into an accelerated electron beam.

In accordance with another aspect of the present invention the anode target includes a continuous resistive surface layer which preferably has a central high resistance region and a lower resistance border region.

In accordance with still another aspect of the present invention the resistive anode comprises a sapphire substrate having a thin layer of high purity silicon epitaxially grown onto the substrate on the electron beam side of the anode.

In accordance with still another aspect of the present invention the transparent anode is supported on the vacuum window of the chamber housing the image converting apparatus.

These and other aspects of the present invention will become more apparent upon a perusal of the following description and accompanying drawing wherein similar characters of reference refer to similar elements in each of the several views.

DESCRIPTION OF THE PREFERRED EMBODIMENT

Figure 1:
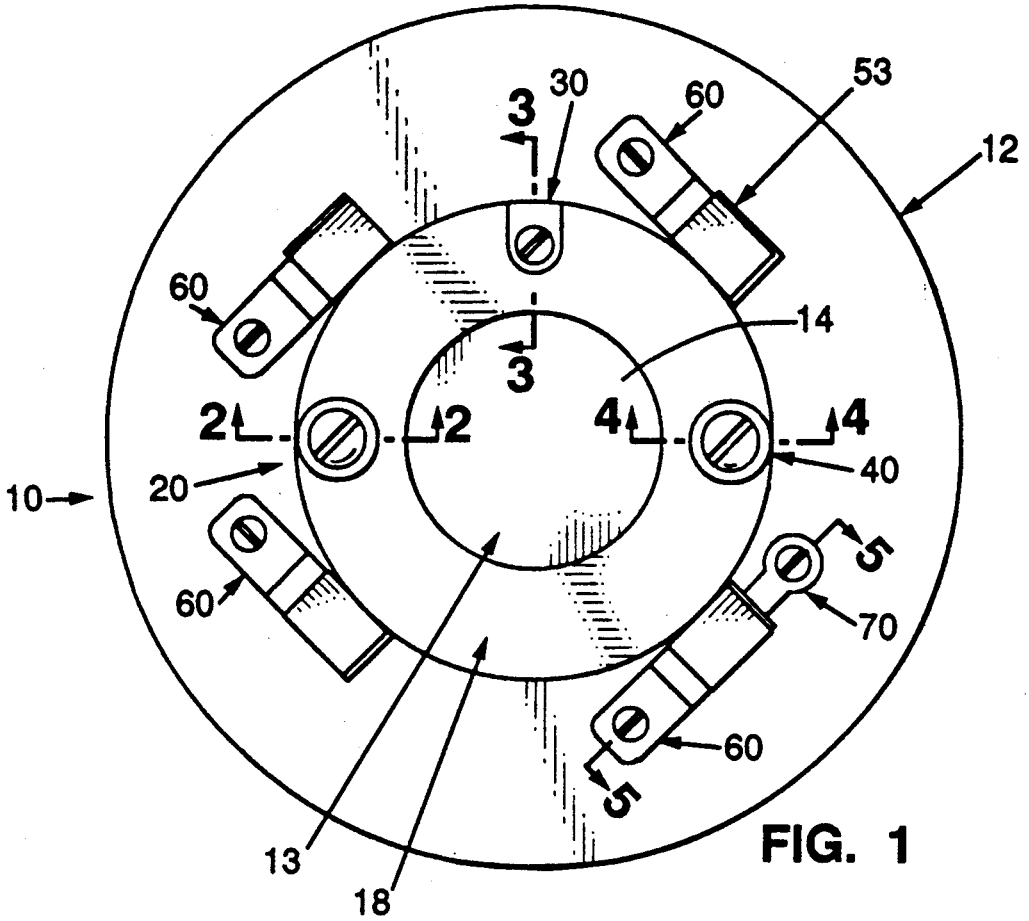
FIG. 1 is a schematic top plan view of a transparent resistive anode image converter constructed in accordance with the present invention.

While the present invention has wider application and utilization, the preferred embodiment of the present invention is directed to a continuous resistive anode encoder or image converter and therefore will be described as such.

Referring now to the drawing with particular reference to FIGS. 1–4, a resistive anode image converter or encoder 10 constructed in accordance with the preferred embodiment of the present invention can be a separate assembly or integrated into another scientific instrument. The encoder 10 includes a evacuated housing or envelope, not shown, or is associated with such a housing of another instrument. The encoder 10 is provided with a sealed transparent window 12, such as of quartz or Pyrex, forming a portion of the vacuum housing.

The portion of the resistive anode encoder 10 positioned within the housing includes a circular dual microchannel plate assembly 13 made up of first and second circular microchannel plates 14 and 15, and a transparent resistive anode or target 16. The anode 16 is supported directly on the window 12, such as by bonding with a silver epoxy onto pads located on the window 12 at positions designated 17.

The first microchannel plate 14 is supported from an annular plate 18, such as of stainless steel or gold plated copper, via a plurality of arms 18*a* each having a gold plated copper bushing 18*b* brazed to the front or top surface of the first microchannel plate 14. The second microchannel plate 15 is secured by similar brazing to the back or bottom surface of a similar annular plate 19.

Figure 2:
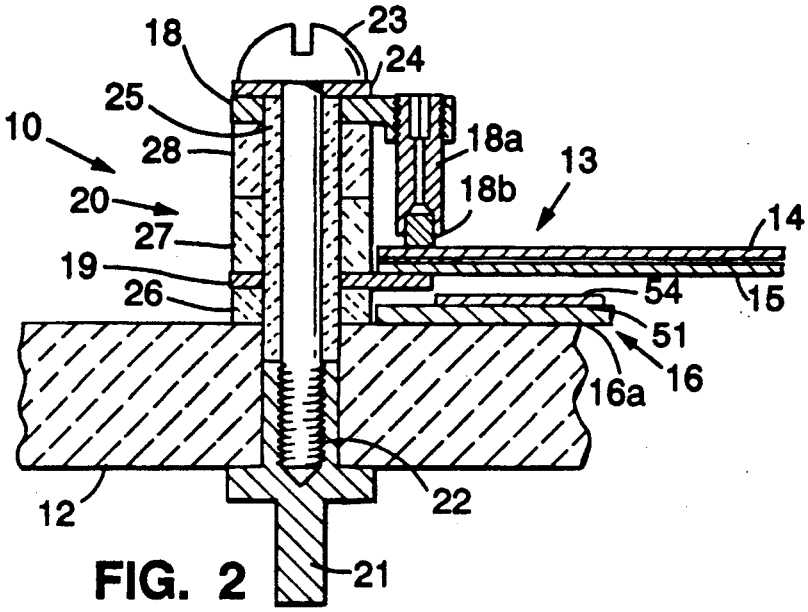
FIGS. 2, 3, 4 and 5 are enlarged elevational sectional views of the structure of FIG. 1 taken, respectively, along lines 2—2, 3—3, 4—4 and 5—5 in the direction of the arrows.
Figure 3:
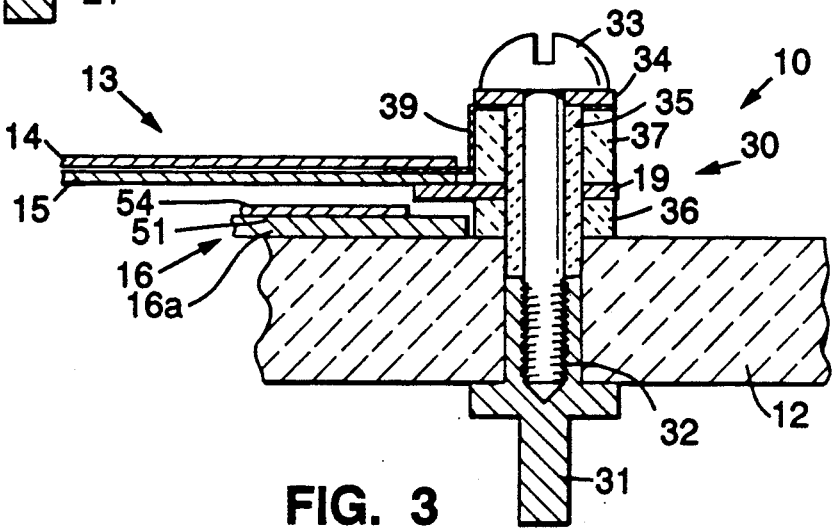
Figure 4:
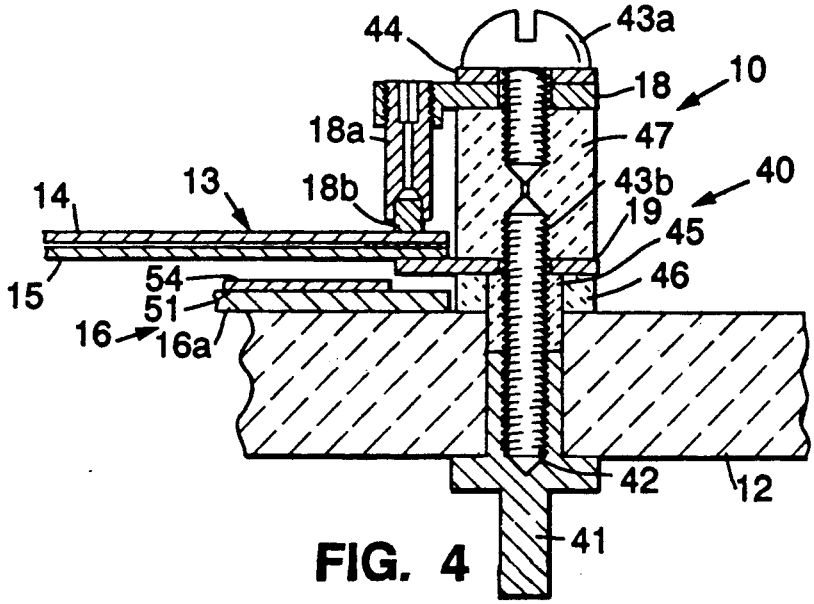

The dual microchannel plate assembly 13 is positioned above the anode 16 by support post and electrical feed through assemblies 20, 30 and 40 which support the annular plates 18 and 19 and which are shown in detail in FIGS. 2, 3 and 4 respectively. Feed through assembly 20 provides the operating potential to the front or upper surface of microchannel plate 14. Assembly 30 provides the potential to the facing surfaces of the plates 14 and 15, and assembly 40 provides the potential to the back or bottom of plate 15. Assemblies 20, 30 and 40 are somewhat similar in construction. The assemblies include external flanged terminal members 21, 31 and 32 which have hollow internally threaded extensions 22, 32 and 42, respectively, each sealably fitted in a passageway drilled through the window 12.

Referring to FIG. 2 the feed through assembly 20 includes an stainless steel screw 23 which is inside the vacuum housing and passes through a stainless steel washer 24 and a hollow cylindrical ceramic insulator 25 and is threaded into the hollow threaded extension 22 of terminal member 21. The insulator 25 passes through the annular plates 18 and 19 which support the microchannel plates 14 and 15, respectively, and an annular ceramic spacer 26 surrounds the insulator 25 and separates the bottom or back surface of the microchannel plate 15 the desired distance from the anode 16. A pair of annular ceramic spacers 27 and 28 surround the insulator 25 between the annular support plates 18 and 19 and separate the microchannel plates 14 and 15 by the desired distance. The electrical connection from terminal 21 to the front of microchannel plate 14 is through the terminal extension 22, the screW 23, the Washer 24, the support plate 18, the arms 18*a* and the bushings 18*b*.

Referring to FIG. 3 the feed through assembly 30 includes a screw 33 inside the vacuum housing which passes through a stainless steel washer 34 and a hollow cylindrical ceramic insulator and screws into the extension 32 of terminal member 31. An annular ceramic spacer 36 surrounds insulator 35 between the window 12 and annular support plate 19 and separates the anode and second microchannel plate 15 the desired distance. An annular ceramic spacer 37 surrounds the insulator 35 between the washer 34 and the annular plate 19. An electrical connection tab, such as of gold coated beryllium, extends from between the washer 34 and the upper ends of both the insulator 35 and the spacer 37 and is brazed to the facing surfaces of the microchannel plates 14 and 15. Electrical connection is made between the facing surfaces of the microchannel plates 14 and 15 and the terminal member 31 via the tab 39, the washer 34 and the screw 33.

Referring now to FIG. 4 the feed through assembly 40 includes a screw 43*a* which passes through a washer 44 and screws into a threaded bore in a cylindrical ceramic spacer 47 which is in turn screwed onto a screw extension 43*b* which passes through the annular plate 19 and screws into the terminal extension 42. A hollow cylindrical insulator 45 surrounds the screw extension 43*b*, and an annular ceramic spacer 46 is positioned around the insulator 45 between the window 12 and the annular plate 19. Electrical connection is made between the back or bottom side of microchannel plate 15 and terminal member 41 via annular plate 19 and screw extension 43*b*.

Figure 6:
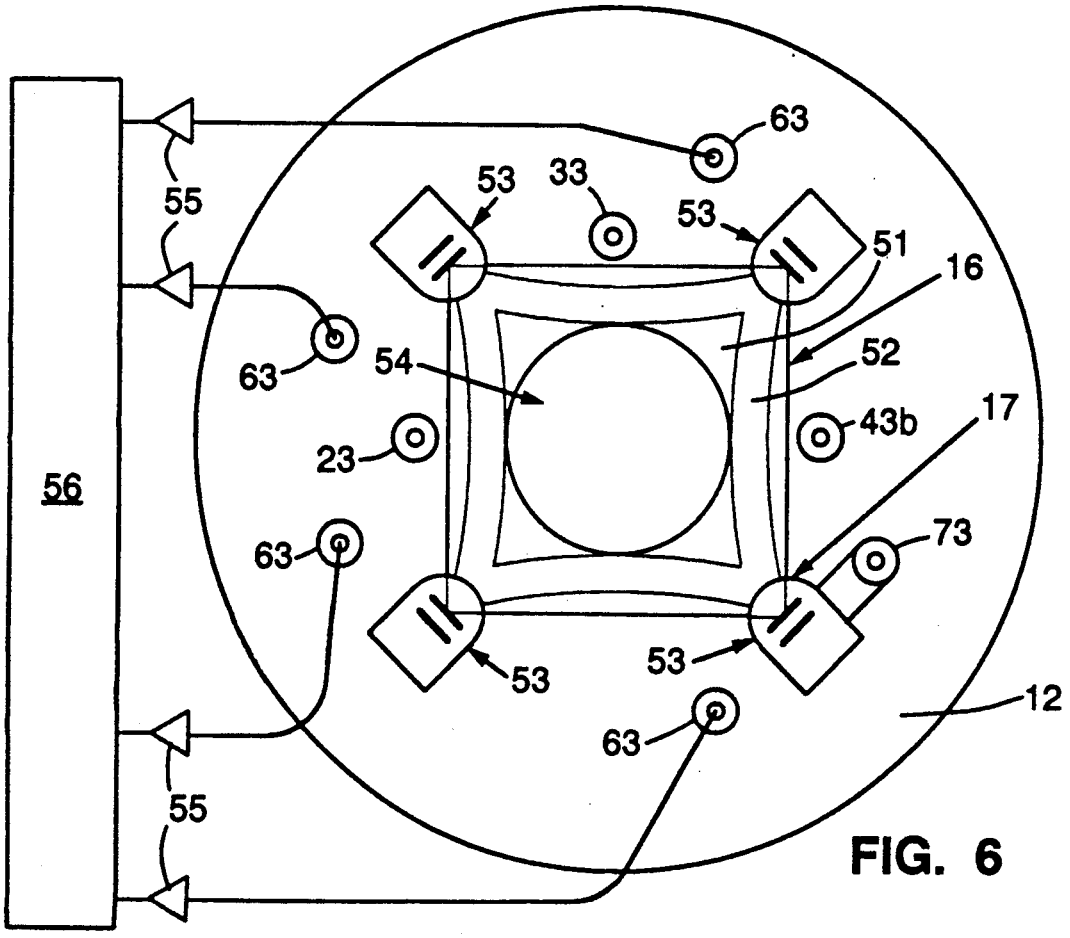
FIG. 6 is a schematic plan view of the anode shown in FIGS. 2–4 with the addition of a partial block diagram .

Referring now to FIG. 6 the transparent anode 16 has a central, high resistance, active sensing layer or film region 51 surrounded by a lower resistance border region 52 extending to four corner capacitor terminal contacts 53. The optically transparent, resistive film on region 51 has both the desired visual light transmission capabilities (transmission efficiencies on the order of 50% at wavelengths on the order of 500 nanometers) and the necessary high resistive values required for the accurate detection of the position of charge pulses arriving at the anode 16. An appropriate anode is the silicon on sapphire anode produced with a thin layer of high purity silicon epitaxially grown onto the sapphire substrate 16*a* as described below.

A circular screen 54 of a fluorescent film, such as 2 microns thick zinc cadmium sulfide phosphor sold as P-20 by USR Optonix Inc. and sprayed on the anode 16, covers the center of the active area 51 of the transparent anode 16.

The capacitor terminals 53 are each connected via amplifiers 55 to a pulse position circuit 56. The terminals 53 detect electrical signals on the active region 51 of anode 16 on a real time basis which signals represent the spatial coordinates of the points of impact of the electrons which comprise the electron image that impinges upon the resistive anode 16 from the dual microchannel plate assembly 13. These electrical signals are amplified by amplifiers 55, and the pulse position circuit 56 converts the amplified signals into electrical signals which represent the spatial coordinates of the points of impact of the electrons on the anode 16. The construction and operation of the pulse position circuit 56 is well-known in the art and a specific implementation thereof is described in U.S. Pat. No. 3,965,354.

Figure 5:
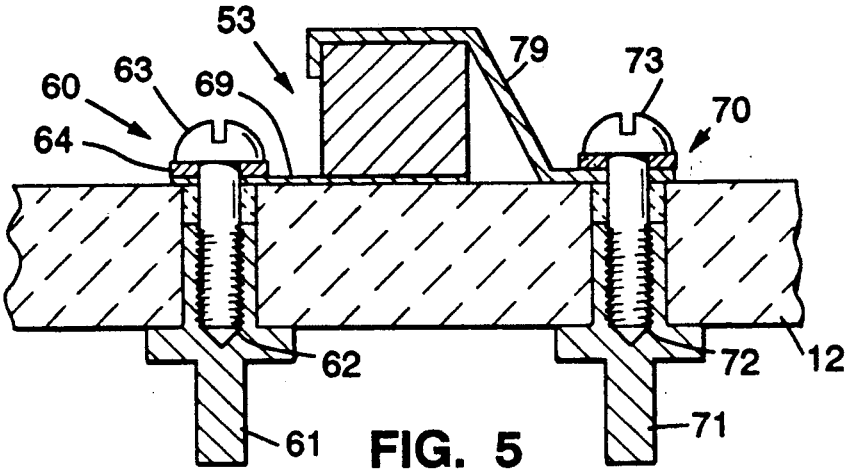

Referring now to FIG. 5 there are shown the electrical feed through assemblies 60 and 70 for capacitor terminals 53 and the operating potential on the anode 16, respectively. Assembly 60 includes an external terminal member 61 having an extension 62 sealably fitted in a passageway through the window 12 and into which is screwed a screw 63 which clamps a washer 64 against a conductive tab 69 connected to the capacitor terminal 53. The anode feed through assembly 70 includes an external terminal member 71 having an extension 71 connected to a screw 73 which passes through an anode electrode 79.

Figure 7:
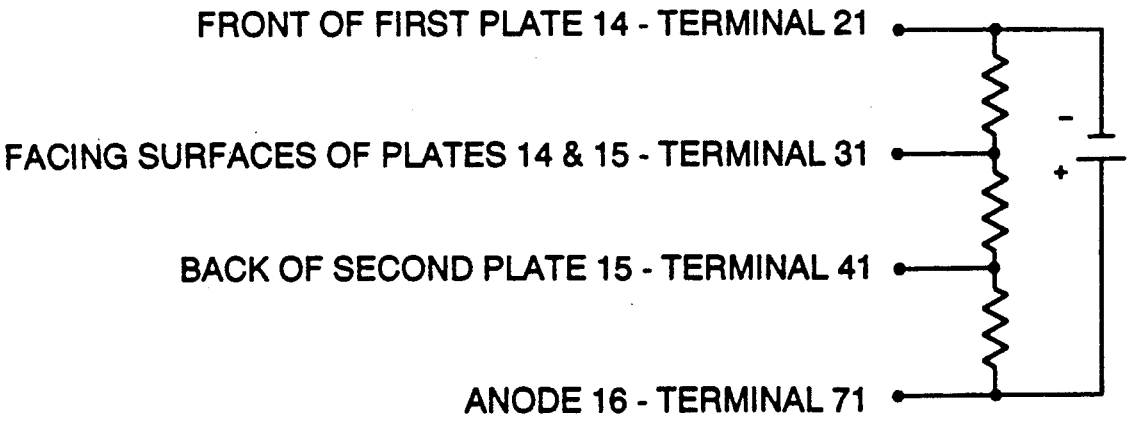
FIG. 7 is a schematic circuit diagram illustrating the operating potentials of the elements of the image converter of this invention.

FIG. 7 is a schematic circuit diagram illustrating the relative voltages on the front surface of the first microchannel plate 14 via terminal 21, on the facing surfaces of the first and second plates 14 and 15 via terminal 31, on the back surface of the second plate 15 via terminal 41 and on the anode 16 via terminal 71.

In operation radiation incident on the input face of the dual microchannel plate assembly 13 is converted to an electron image, and this electron signal is amplified in the channels of the dual microchannel plate assembly 13. The burst of electrons exiting the dual microchannel plate assembly 13 impacts upon the fluorescent screen/resistive anode 16 producing a visible light image which is transmitted through the anode 16 and the window 12. The charge in the burst of electrons is also distributed to the four capacitor terminals or electrodes 53 connected to the anode 16. The magnitude of the charge arriving at each capacitor terminal 53, as amplified in amplifiers 55, is analyzed in the pulse position circuit 56 which calculates the position of the centroid of this charge pulse on the anode 16.

Thus, the transparent resistive anode image converter 10 provides both a quantitative measure of the distribution and intensity of the radiation via the signals produced from the position computing electronic circuitry 56 as well as a visual or qualitative indication of the position and intensity of the radiation incident on the microchannel plate assembly 13. The dual detector and display configuration of this invention extends the useful signal input dynamic range of a resistive anode image converter and in effect combines the capability of a resistive anode image converter and an image intensifier tube.

The illustrated mounting arrangement for the transparent resistive anode image converter 10 is specifically appropriate for secondary ion mass spectrometry applications, such as in the CAMECA IMS-3 or 4f Ion Microanalyzers.

In an operative embodiment of this invention the operating potentials on the elements of the resistive anode encoder 10 as illustrated in FIG. 7 are 0 volts on the front surface of the first microchannel plate 14, +1 kv on the facing surfaces of the microchannel plates 14 and 15, +2 kv on the back surface of the microchannel plate 15 and +2.2 kv on the anode 16. Greatly enhanced visual light image output can be achieved by increasing the voltage on the anode such as to +7 kv.

The dual microchannel plate assembly 13 can be of the commercially available chevron configuration type such as an 18 mm active area type available from Galileo Electroptic in Sturbridge, Mass.

The resistive anode 16 can be produced in various ways. In accordance with the preferred embodiment of this invention the transparent anode 16 is a silicon thin film or layer, approximately 0.5 micrometers thick, which is epitaxially grown onto the upper surface of an optically polished sapphire ($Al_2O_3$) substrate 40.5 mm thick. The required anode resistivities on this silicon thin film are produced by ion implanting $^{11}B+$ into the film. The fabrication of a resistive anode with this silicon on sapphire wafer material is comprised of the following steps:

1. Uniform low dose $^{11}B+$ implant across the whole sapphire wafer followed by a thermal anneal.
2. Spin on photoresist, then mask and then etch out the border regions.
3. A uniform higher dose $^{11}B+$ implant into border regions 52 followed by a thermal anneal.
4. Cut the wafer into 27 mm square anode structures and coat with phosphor.

Appropriate resistivities for the central and border regions of the anode are about 100 kiloohms/square for the central active region 51 and about 5 kiloohms/square for the border region 52.

In place of mounting on a quartz window, the transparent anode assembly 13 can be mounted on other materials. Depending upon the material it may be necessary to provide some means for transmitting the optical output from the anode plate 16 to a light sensor.

The transparent anode of this invention can be utilized either with a resistive anode having a uniform resistive film or with an anode having spaced geometric pattern of conducting wedges and strips. In this latter construction the conductive film can be, for example, indium tin oxide.

While the invention has been described in terms of a preferred embodiment, it will be apparent to those persons skilled in the art that numerous modifications can be made thereto without departing from the spirit and scope of the invention. It is intended that these modifications fall within the spirit and scope of the following claims.

We claim:

1. An apparatus for imaging incident energetic radiation comprising:

means for detecting said radiation and for producing an amplified and accelerated electron image which corresponds spatially to the incident radiation, a target disposed in the path of said amplified and accelerated electron image, and means electrically coupled to said target for producing signals representative of at least one of the two spatial coordinates of the points of impact of the electrons upon said target which comprise said electron image, said target being at least partially transparent for producing a visible light output.

2. The apparatus of claim 1 where said target is at least partially transparent to visual light and includes a layer of fluorescent material.

3. The apparatus of claim 1 wherein said target includes a continuous resistive surface layer facing said means for detecting said radiation and for producing said electron image.

4. The apparatus of claim 1 where said target includes a sapphire substrate and a thin layer of high purity silicon epitaxially grown onto said substrate.

5. The apparatus of claims 2, 3 or 4 wherein said target has a central high resistance region and a lower resistance border region.

6. The apparatus of claim 1 including a transparent vacuum wall member and means mounting said target on said wall member.

7. The apparatus of claim 6 wherein said wall member is quartz.

8. The apparatus of claims 3, 4 or 6 where said target is at least partially transparent to visual light and includes a layer of fluorescent material on the surface of said target facing said means for detecting said radiation and for producing an amplified and accelerated electron image.

9. The apparatus of claims 1, 2, 3, 4 or 6 wherein said means for detecting said radiation and for producing an amplified and accelerated electron image includes a dual microchannel plate assembly.

10. Apparatus for converting an energetic radiation image comprising:

means for converting the energetic radiation image into an accelerated electron image, means for impacting said accelerated electron image onto a target to create both a charge image and a visible light image at electron impact, means for conducting the charge of said impacted electron image to a plurality of positions distributed on said target, means for sensing the charge at said distributed positions, means for converting the magnitude or transit time of the sensed charge into the spatial coordinates of electron impact, and means for transmitting said visible light image for viewing.

11. The apparatus of claim 10 wherein said transmitting means includes a vacuum window and said impacting means includes an anode target, said anode target being supported on said window.

12. The apparatus of claim 10 wherein said converting means includes a dual microchannel plate assembly.

13. The apparatus of claim 10 wherein said impacting means includes an anode target having a central region of high electrical resistivity and at least partial visible light transmissivity over the area of said charge image and said visible light image.

14. The apparatus of claims 10 or 13 wherein said transmitting means includes a vacuum window.

15. The apparatus of claim 13 wherein said anode target includes a sapphire substrate.

16. The apparatus of claim 15 wherein said substrate includes an epitaxially grown layer of high purity silicon facing said means for converting the energetic radiation image into an accelerated electron image.

17. The apparatus of claims 13, 15 or 16 including a border region of lower resistivity around said central region of high electrical resistivity.

18. A resistive anode image converter for imaging energetic radiation comprising:

a vacuum housing, means mounted in said housing for detecting said radiation and for producing an amplified and accelerated electron image which corresponds spatially to the incident radiation, a continuous resistive anode target disposed in the path of said amplified and accelerated electron image, said anode target being transparent to visible light and having a layer of fluorescent material on the target surface facing said detecting and producing means, a transparent window in said vacuum housing for transmitting visible light from said fluorescent material and transmitted through said anode target and means electrically coupled to said continuous resistive anode target for producing signals representative of at least one of the two spatial coordinates of the points of contact of the electrons upon said anode target which comprise said electron image.

19. The apparatus of claim 18 wherein said means for detecting said radiation and for producing an amplified and accelerated electron image includes a dual microchannel plate assembly.

20. The apparatus of claim 18 wherein said anode target includes a sapphire substrate and a thin layer of high purity silicon epitaxially grown onto said substrate.

21. The apparatus of claims 18 or 19 wherein said resistive anode target includes a central region of high electrical resistivity and a border region around said central region and of substantially lower resistivity than the resistivity of said central region.

22. A method of converting an energetic radiation image comprising:

converting the energetic radiation image into an accelerated electron image, impacting said accelerated electron image onto a target to create both a charge image and a visible light image at electron impact, conducting the charge of said impacted electron image to a plurality of positions distributed on said target, sensing the charge at said distributed positions, converting the magnitude or transit time of the sensed charge into the spatial coordinates of electron impact, and transmitting said visible light image for viewing.

23. The method of claim 22 wherein said transmitting step includes passing said visible light image through a transparent window of a vacuum chamber.

* * * * *